US005188578A

United States Patent [19]

Voigt

[11] Patent Number: 5,188,578

[45] Date of Patent: Feb. 23, 1993

[54] SKIING SIMULATOR AND TRAINING DEVICE

[76] Inventor: Bruce S. Voigt, 42677 Cedar, Big Bear Lake, Calif. 92315

[21] Appl. No.: 819,788

[22] Filed: Jan. 13, 1992

[51] Int. Cl.[5] ..... A63B 69/18

[52] U.S. Cl. ..... 482/71; 482/79; 482/146

[58] Field of Search ..... 482/71, 79, 80, 146, 482/148; 434/253; 36/114, 115, 116, 132, 62, 64, 7.6, 7.5

[56] References Cited

U.S. PATENT DOCUMENTS

| | | | |
|---|---|---|---|
| 2,253,012 | 8/1941 | Benner et al. . | |
| 2,455,274 | 9/1945 | Scriver . | |
| 2,964,315 | 11/1959 | Dinning . | |
| 3,565,424 | 2/1971 | Macabet et al. . | |
| 3,612,520 | 10/1971 | Chang et al. . | |
| 3,622,172 | 11/1971 | Goodwin . | |
| 3,729,207 | 4/1973 | Reynolds . | |
| 4,101,136 | 7/1978 | Corll . | |
| 4,199,880 | 4/1980 | Frey | 36/132 |
| 4,251,068 | 2/1981 | Tarmacki . | |
| 4,286,397 | 9/1981 | Booty | 36/132 |
| 4,294,025 | 10/1981 | Keller | 36/132 |
| 4,299,037 | 11/1981 | Carey | 36/62 |
| 4,461,104 | 7/1984 | Calkin et al. | 36/132 |
| 4,619,059 | 10/1986 | Koniuk | 36/132 |
| 4,727,662 | 3/1988 | Ilon | 36/62 |
| 4,958,445 | 9/1990 | Brisco | 36/132 |

*Primary Examiner*—Richard J. Apley
*Assistant Examiner*—Lynne Reichard
*Attorney, Agent, or Firm*—Herb Boswell

[57] ABSTRACT

A skiing simulator and training device has first and second bodies that each have a top surface sized and shaped to mate against the sole of a ski boot. Each of the bodies further includes an arcuate bottom surface. A connecting member movably connects the first and second bodies together and attaching brackets on the bodies connect the bodies to the sole of a ski boot. The bottom surfaces of the bodies are formed as tapering surfaces of rotation that are centered about an axis that is essentially parallel with a heel to toe axis of a ski boot.

20 Claims, 2 Drawing Sheets 10
12
14
16
18
20
22
24
26
28
30
32
38
46
50
54
60
62
64
68
74
76
78
80
82
5
5

20
50
24
36
26
70
66
64
52
34
76
80

66
64
68
24
28
46
26
34
36
38
40
72
54
82
22
48
30
38
62
78
32
46
52
42
58
20
44
56
80
70
76

SKIIING SIMULATOR AND TRAINING DEVICE

BACKGROUND OF THE INVENTION

This invention is directed to a device that attaches to the bottom of ski boots for simulating ski movements. The devise is used for training and conditioning of skiers. The device has first and second sections each of which has a tapered surface of rotation as the bottom surface thereof. This allows for side to side rolling movements, front to back rolling movements and complex combinations of side to side and front to back rolling movements by users of the device.

Modern snow skis are flexible along their elongated axis. This allows the tip and the heel of the ski to flex with respect to the center of the ski. Further, such skis include hardened metal edges that bite into a snow or icy surface as a skier turns. In making a turn, as the metal edge of the ski bites into the snow surface both the toe and the heel of the ski naturally flex upwardly giving the ski an upwardly directed concave curve. This curvature of the ski causes the ski to turn or rotate.

In advanced skiing techniques, i.e. parallel skiing, the skier constantly weights one edge or the other of the skis putting more pressure on the weighted ski edge compared to the unweighted ski edge; however, the pressure on the weighted edge of the down-hill ski is different from the pressure on the weighted edge of the up-hill ski. This causes a natural rolling of the skier's ski boots and thus the skier's feet and legs located therein in a side to side manner. Because the pressure to the down-hill ski is different from the pressure to the up-hill ski, the amount of roll of one ski boot is not always the same as the amount of roll of the other ski boot. Further depending on particular maneuvers the skier is making, the advanced skier constantly weights and unweights his or hers skis as well as shifts his or hers weight on the skis either to the tips of the skis or the heel of the skis. This creates a forward or rearward rolling motion of the skier with respect to the ground.

Various prior training devices have been developed to assist a skier in learning to ski, improving skiing skills or in conditioning training. In order, however, to fully simulate skiing such training devices must allow for both side to side rolling motion and front to back rolling motion. Additionally, such training devices must allow for the individual movements of the right and left feet in an independent manner as is experienced in actual skiing.

An early training device described in U.S. Pat. No. 2,253,012 is essentially a pair of ski like slats that have been equipped with caster wheels. Such a training device would, of course, require a large smooth hard surface area for use thereon, as for instance, a smooth hill or the like. A similar type device is described in U.S. Pat. No. 3,622,172. In this device an elongated ski like structure is equipped with barrel like casters along its length. As with the previous device, this device also requires a large expanse of a smooth hard surface in order to be utilized. Such smooth hard surfaces are not soft and forgiving like a snow surface. Thus the users of these devices are subject to injury.

A further type of ski training device actually utilizes a pair of skis. The user secures the skis to his feet utilizing ski boots in a normal manner and then steps onto a platform that has the ability to rock side to side. This device is shown in U.S. Pat. No. 2,964,315. However, while the platform may rock side to side, the individual skis do not. As such the user does not get a full range of movement from this type of device. A similar type device is shown in U.S. Pat. No. 4,101,136. In this device the individual feet of the skiers can rock independently side to side. Further the device allows for the feet to slide fore and aft. However, this device does not provide for a fore and aft rolling motion that is naturally experienced during skiing because of the flexure of the ski.

A further training device is shown in U.S. Pat. No. 2,455,274. Because of the construction of this training device it is generally only useful for older, simplified skiing techniques, as for instance, teaching "stem-christies" and not more modern parallel skiing techniques. This device does not provide for individual rolling motion of the right and left feet independent of one another. An additional training device is shown in U.S. Pat. No. 3,729,207. This device allows for side to side movement and side to side rolling of the individual left and right feet, however common with certain of the above devices it does not allow for a fore, aft rolling that simulates flexure of the skis. A further training device is shown in U.S. Pat. No. 3,565,424 which again, while allowing for side to side rocking motion of the individual feet, does not simulate fore and aft rocking motion.

The exercise device of U.S. Pat. No. 4,251,068 allows for side to side rocking motion and in addition allows for rocking motion to the front around a rounded edge of the bottom of the device. The rear of this device, however, is squared off much like the transom of a boat and does not simulate the rearward rocking motion that is also encountered during skiing. And finally U.S. Pat. No. 3,612,520 shows a rounded disk like platform that can be utilized for exercising to build up the legs. In this device both feet are firmly planted on a non-movable surface and while the over all body is allowed to rock side to side and backward and forward, the individual feet of the user are not.

BRIEF DESCRIPTION OF THE INVENTION

In view of the above it is a broad object of this invention to provide for a skiing simulator and training device that allows for full independent range of motion of each of the legs of the skier in a manner mimicking movement incurred during actual skiing.

It is a further object of this invention to provide a skiing simulator and training device that easily mounts and dismounts from a pair of ski boots thus making the training device simple and convenient to use.

It is an additional object of this invention to provide a skiing simulator and training device that is adaptable to large variety of boot sizes, thus allowing a single device to be utilized by various skiers of different sizes and skill levels without complicated adjustments or the like.

In accordance with this invention there is provided a device for attaching to ski boots which comprises a first body having a top surface sized and shaped to mate against the sole of a ski boot and a second body also having a top surface sized and shaped to mate against the sole of a ski boot. Both the first and second bodies each have arcuate bottom surfaces. There is further provided a connecting means for movably connecting the first body to the second body and attaching means for attaching the connected first and second bodies to a ski boot.

The connecting means is for variably positioning the first and second bodies with respect to one another. In preferred embodiments of the invention, the connecting means allows for slidably connecting the first and second bodies to one another and further includes a biasing means for biasing the first and second bodies toward one another. The connecting means preferably includes a connecting member that is positioned in appropriate passageways formed in the first and second body for variably positioning the first and second body with respect to one another.

In preferred embodiments of the invention the bottom surface of each of the first and second bodies is essentially arcuate in cross section about an axis that is essentially parallel with a heel to toe axis of the ski boot. Further, at least a portion of the bottom surfaces of each of the first and second bodies is essentially tapered in cross section when viewed about an axis that passes from side to side through a ski boot and is essentially perpendicular to the heel to toe axis of the boot. As so formed at least a portion of the bottom surface of the first and second bodies is formed as a portion of a conical surface of rotation that is centered about an axis that is essentially parallel with a heel to toe axis of the ski boot.

The attaching means preferably includes first and second brackets each for fitting over the edge of the sole of the ski boot with one of the brackets attaching to the first body and the other of the brackets attaching to the second body such that one of the brackets fits over the sole of the ski boot at the toe of the ski boot and the other of the brackets fits over the sole of the ski boot at the heel of the ski boot.

Further, in accordance with this invention there is provided a device for attaching to a ski boot that is composed of a body having front and rear sections. Each of the front and rear sections has a top surface for mating against the sole of a ski boot. There is further provided means for connecting the body to the sole of a ski boot. Each of the front and rear sections has a bottom surface for contacting a support surface. At least a portion of the bottom surface of each of the front and rear sections is formed as a tapering surface of rotation that is centered about an axis that is essentially parallel with the heel to toe axis of the ski boot. The tapering surface of rotation on the front section tapers from a broad area positioned proximal to the rear section to a narrow area positioned distal to the rear section and the tapering surface of rotation of the rear section tapers from a broad area positioned proximal to the front section to a narrower area positioned distal to the front section.

In one embodiment of the invention the body is an integrally formed body with the first and second sections integrally formed together. In a preferred embodiment of the invention the first and second sections are separately formed and are movable with respect to one another such that they can be positioned in variable positions with respect to one another. Such an embodiment includes a connecting means for movably connecting the front and rear sections to one another with at least one of the front or rear sections being movable with respect to the connecting means. In even more preferred embodiments both the sections are movable with respect to the connecting means and the device includes a biasing means for biasing the front and rear sections toward one another.

DETAILED DESCRIPTION OF THE DRAWINGS

This invention will be better understood when taken in conjunction with the drawings wherein.

This invention utilizes certain principles and/or concepts as are set forth in the claims appended hereto. Those skilled in the mechanical arts will realize that these principles and/or concepts are capable of being utilized in a variety of embodiment that may differ from the exact embodiments utilized for illustrative purposes. For this reason this invention is not to be construed as being limited solely to the illustrative embodiments, but should only be construed in view of the appended claims.

DETAILED DESCRIPTION OF THE INVENTION

Figures 1, 2, 4:
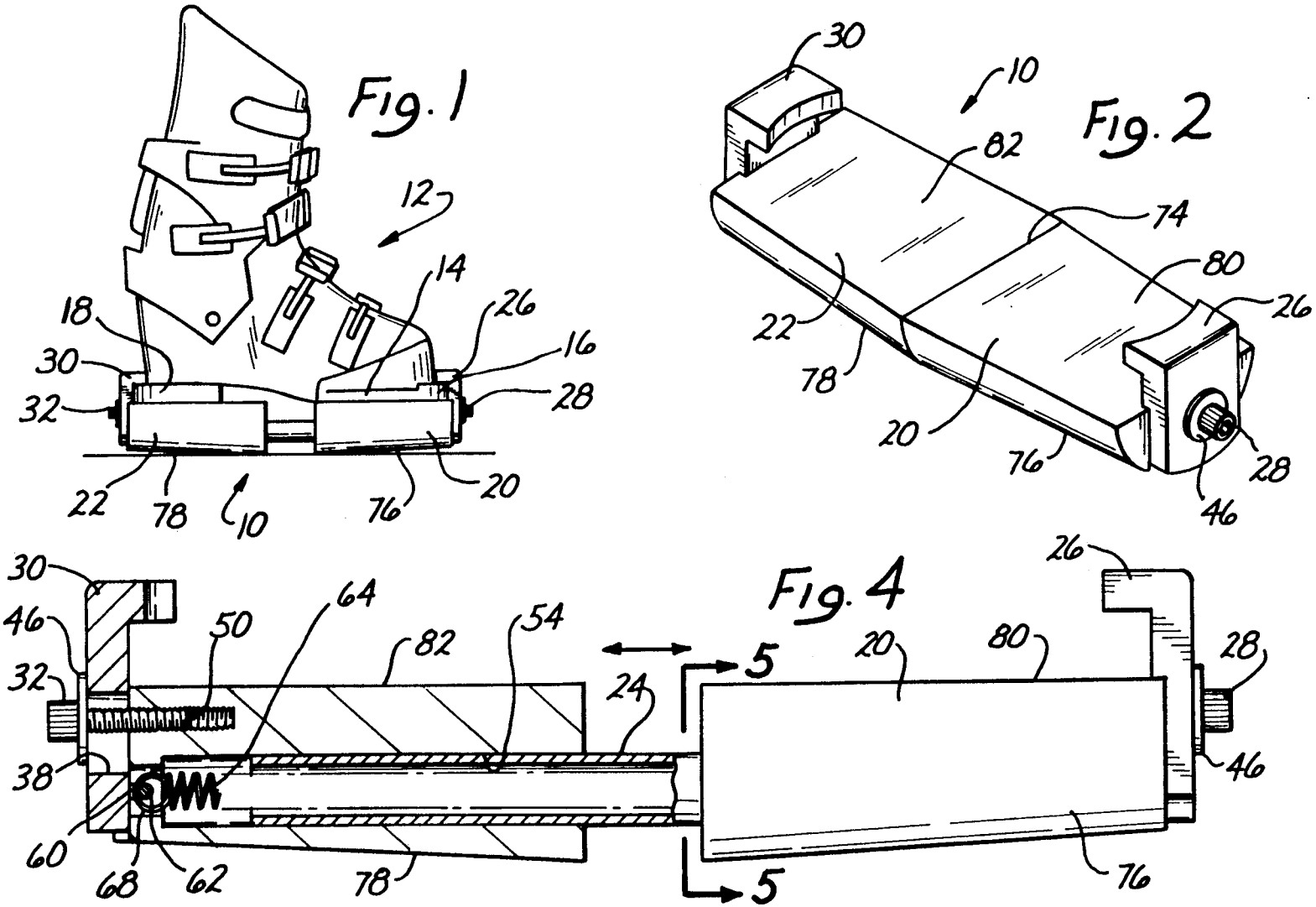
FIG. 1 is a side elevational view of a ski simulator and training device of the invention as attached to a ski boot.
FIG. 2 is an oblique view of the ski simulator and training device of FIG. 1.
FIG. 4 is a side elevational view in partial section of the ski simulator and training device of FIG. 2.

Shown in FIG. 1 is a skiing simulator and training device 10 of the invention as attached to a ski boot 12. The device 10 is utilized in pairs, one of the pairs fitting on the right foot ski boot and the other of the pairs fitting on the left foot ski boot. Both of the devices would be identical and interchangeable between left and right sides. The device 10 fits to the boot 12 by clamping to the sole 14 of the boot 12 at the toe 16 and the heel 18.

The main components of the device 10 as seen by the user of the device consist of a first body or front section 20, a second body or rear section 22 and a connecting member 24. Further included are a front bracket 26 that is attached to the first body 20 via a bolt 28 and a rear bracket 30 that is attached to the second body 22 via a bolt 32. Each of the front and rear brackets 26 and 30 are identical.

The brackets 26 and 30 are "L" shaped having a vertical portion 34 and a horizontal portion 36 attached thereto. A vertical extending slot 38 is formed in the vertical portion 34 for receiving either the bolt 28 or the bolt 30 of the front or rear bracket 26 or 30 respectively. The horizontal portion 36 includes a radius edge 40 for engaging either the toe or the heel portion of the ski boot 12. The horizontal portion 36 fits over the lip of the ski boot 14 projecting from either the heel or toe areas 16 and 18 of the boot 12. The slot 38 allows either the bracket 26 or the bracket 30 to be vertically adjusted to its respective body member 20 or 22 for adapting to different thicknesses of soles 14 on different sizes or brands of ski boots.

The first body 20 has a square sided channel 42 formed therein that is of the same width as is the bracket 26. A threaded opening 44 receives the bolt 28 for attaching the bracket 26 to the first body 20. A washer 46 is positioned around the bolt 28 between the head of the bolt and the bracket 26. In a like manner a channel 48 is formed in the second body 22 for receiving the bracket 30. A threaded opening 50, seen in FIG. 4, receives the bolt 32 to hold the back bracket 30 to the second body 22. A further washer, also identified by the numeral 46, is utilized on the bolt 32.

A first passageway 52 is formed in the first body 20 and extends axially through that body along an axis that is essentially parallel to the heel-toe axis of the ski boot 12. In a like manner a second passageway 54 is formed in the second body 22. The passageways 52 and 54 are sized and shaped so as to accept the connecting member 24 allowing the connecting member 24 to slide in the passageways 52 and 54. A cross slot 56 formed in the channel 42 intersects the passageway 52. The cross slot 56 is sized and shaped to contain a pin 58. In a like manner a cross slot 60 (seen in FIG. 4) is formed in the second body 22 intersecting the passageway 54. The cross slot 60 is sized and shaped to contain a pin 62.

The connecting member 24 is hollow. A tension spring 64 is located in part within the interior of the hollow connecting member 24. The front loop 66 of the spring 64 is positioned around the pin 58 holding the front of the spring 64 to the front end of the first body 20. In a like manner, the rear loop 68 of the spring 64 is positioned around the pin 62 to hold the other end of the spring 64 to the body 22. Interlocking of the pin 62 and the loop 66 and positioning of the pin 62 and the slot 60 are seen in section in FIG. 4. Together the pins 58 and 62 hold the tension spring 64 to the bodies 20 and 22. They bias the bodies 20 and 22 toward one another. The spring 64 allows the bodies 20 and 22 to be spread and, as they spread, to slide along the connecting member 24. The tension spring 64 holds the bodies 20 and 22 to the connecting member 64 while urging or biasing these members back to a rest position wherein the edge 70 of the first body 22 is abutted against the edge 72 of the second body 22.

To mount the device 10 to the ski boot 12 the user simply needs to grasp the first body 20 in one hand and the second body 22 in the other hand and pull them away from one another until the brackets 26 and 30 are separated a distance sufficient to fit over the toe and heel portion of the sole 14 of the ski boot 12. Pressure is then released from the first and second bodies 22 and 24 allowing the tension spring 64 to bias the bodies toward one another and to slide the bodies 22 and 24 towards one another on the connecting member 24 until the sole 14 of the ski boot 12 is locked underneath the vertical portions 36 of the brackets 26 and 30. Because the bodies 20 and 22 are free to slide along the connecting member 24 the brackets 26 and 30 can be positioned from each other at a variety of distances. This allows the device 10 of the invention to be a "one size fits all" type of device—that is the device 10 of the invention is capable of fitting on a variety of sizes and brands of ski boots 12 ranging from children to large male adults.

The variable positioning of the bodies 20 and 22 on the connecting member 24 allow for adjustment with respect to the length of the sole 14 of the ski boot 12 on which the device 10 is used and the slidability of the brackets 26 and 30 in the channels 42 and 48 in combination with the slots 38 and the bolts 28 and 32 allow for vertical adjustment of the device 10 to account for any variances in the thickness of the sole 14 of the ski boot 12. As so constructed, the device 10 is usable on a variety of different sizes and brands of ski boots 12.

The embodiment of the invention as depicted in FIGS. 1, 2, 3, 4 and 5 is the preferred embodiment of the invention in that only a single device 10 is needed to fit on a variety of different ski boot sizes and brands. In a further embodiment the first and second bodies 20 and 22 would in fact be first and second sections of a monolithic body. Such a device would be as is depicted in FIG. 2 except the seam line 74 that defines the two edges 70 and 72 of the respective separate bodies 20 and 22 of the preferred embodiment would be absent. In this alternate embodiment since there would be no variability as to the length of the device 10, a variety of different sizes of the device would be necessary for fitting on different lengths of ski boots. In a further embodiment also not illustrated, the connecting member 24 would not slide in both of the first and second bodies, but would be fixed with respect to one body and would only slide in the other. It is further evident that the shape of the connecting member 24 and the shape of the corresponding passageway 52 and 54 need not necessarily be round as depicted in the illustrative embodiment, but could have a cross sectional shape that is square, rectangular, triangular or a variety of other geometrical shapes.

Figures 3, 5:
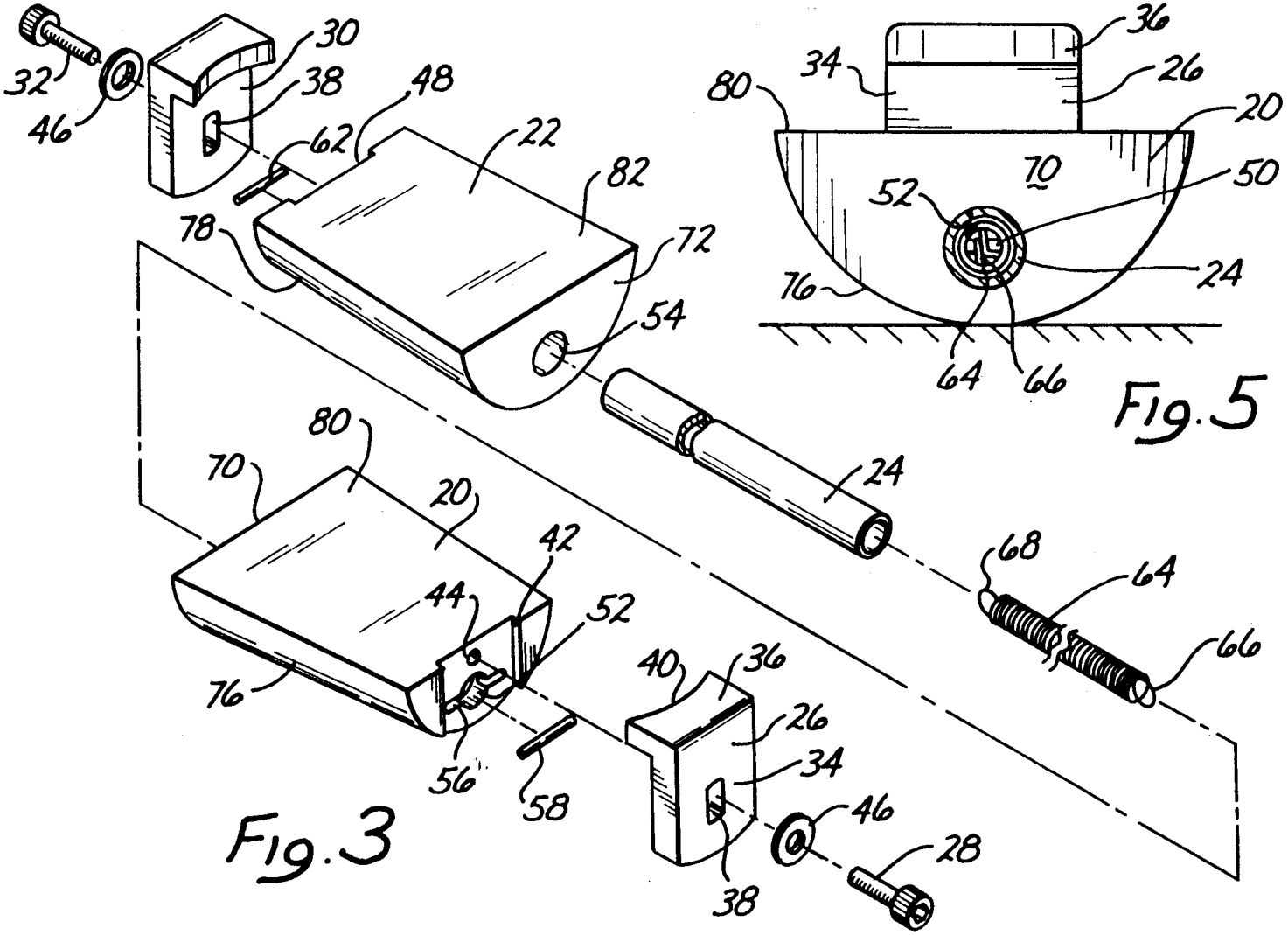
FIG. 3 is an expanded oblique view of the device of FIG. 2.
FIG. 5 is an elevational view about the line 5—5 of FIG. 4.

The bottom surface 76 of first body 20 and the bottom surface 78 of second body 22 are arcuate in cross section. The top surface 80 of first body 20 and the top surface 82 of second body 22 are essentially flat for fitting against the bottom surface of the sole 14 of the ski boot 12. As seen in FIG. 5, the bottom surface 76 is arcuate with its arc centered about an axis that is essentially parallel with an axis that goes from the toe to the heel of the ski boot 12. That is it is parallel to a heel-toe ski boot axis. Additionally, however, the surfaces 76 and 78 are also tapered in moving from the seam line 74 toward the front and rear of the device 10. As seen in FIG. 1 wherein one is looking in elevational view essentially from one side of the ski boot toward the other, the taper of the bodies 20 and 22 is quite evident with the bodies 20 and 22 tapering from a thicker section near where the bodies are positioned toward one another to a thinner section near the heel and the toe of the device 10.

Together the cross sectional arcuate shape and the side view tapered shape results in the surfaces 76 and 78 of the bodies 20 and 22, respectively, being formed as a portion of a conical surface of rotation that is centered about an axis that is essentially parallel to a heel-toe axis of the ski boot 12. The conical surface of rotation of the first body, or front section 20, goes from a thickened area about the seam line 74 tapering down to a more narrow area toward the bracket 26 and in a like manner the conical surface of the body 22 goes from a thicker area near the seam line 74 toward a tapered area toward the bracket 30.

The conical surfaces of rotation on the first and second bodies of the device 10 allow for each of the individual devices 10 to rock side to side in a manner mimicking edging of a ski or from front to aft in a manner mimicking flexure of the toe of the ski or flexure of the heel of the ski. Thus, in use with the skiing simulator and training devices 10 of the invention, the user experiences both a side to side and a fore and aft rocking motion that is similar to that encountered during actual snow skiing.

In use, with one of the devices 10 attached to the left ski boot and a further of the devices 10 attached to the right ski boot, the users of the device 10 experience full ranges of motion identical to that encountered during actual snow skiing. Thus, the devices 10 serve as a full range of motion simulator of a skiing experience. Further, because use of the device 10 allows for actual mimicking of a skiing experience, the devices 10 can serve as training devices for both showing student skiers proper ski movements as well as in conditioning exercises.

A further use of the device 10 is in fitting ski boots to a user. When ski boots are fitted to a user if the user is simply standing on a flat floor the user does not experience the same feel of the boot as would be encountered in an actual skiing experience wherein the boot is allowed to twist from side to side or rock forward and aft. Because the devices 10 of the invention are simple to attach and can fit on essentially any size or brand of ski boot, during purchasing of the ski boot, a pair of the devices 10 can be attached to the boots of the potential purchaser. This allows the potential purchaser to experience the accurate feel of the boots as it will fit the users feet when they rock side to side or fore and aft during skiing.

I claim:

1. A device for attaching to a ski boot comprising:

a first body having a top surface sized and shaped to mate against the sole of a ski boot;

said first body having an arcuate bottom surface;

a second body having a top surface sized and shaped to mate against the sole of a ski boot;

said second body having an arcuate bottom surface;

the bottom surface of each of said first and said second bodies being essentially arcuate about an axis that is essentially parallel with a heel to toe axis of said ski boot and at least a portion of the bottom surfaces of each of said first and said second bodies is essentially tapered about an axis that is essentially perpendicular to said heel to toe axis of said ski boot and passes from side to side through said ski boot;

connecting means for movably connecting said first body to said second body; and attaching means for attaching said connected first and second bodies to a ski boot.

2. The device of claim 1 wherein:

said connecting means includes means for variably positioning said first and second bodies with respect to each other.

3. The device of claim wherein:

said connecting means includes means for biasing said first and second bodies towards one another.

4. The device of claim 1 wherein:

said connecting means includes means for slidably connecting said first and second bodies together.

5. The device of claim 1 wherein:

said connecting means includes a variable positioning means and a biasing means;

said variable positioning means for variably position said first and second bodies with respect to each other; and said biasing means for biasing said first and second bodies towards one another.

6. The device of claim 5 wherein:

said variable positioning means includes sliding means, said sliding means for slidably connecting said first and second bodies together.

7. The device of claim 1 wherein:

at least a portion of said bottom surface of each of said first and said second bodies is formed as a portion of a conical surface of rotation, said conical surface of rotation centered about an axis that is essentially parallel with a heel to toe axis of said ski boot.

8. The device of claim 1 wherein:

said attaching means includes first and second bracket means each adapted for fitting over the edge of a sole of a ski boot, said first bracket means attaching to said first body and said second bracket means attaching to said second body; and one of said bracket means adapted for fitting over the edge of the sole of said ski boot at the toe of said ski boot and the other of said bracket means adapted for fitting over the edge of the sole of said ski boot at the heel of said ski boot.

9. A device for attaching to the bottom surface of a ski boot comprising:

a first body, said first body including an elongated first body passageway sized and shaped to movably retain at least a portion of said connecting member;

a second body, said second body including an elongated second body passageway sized and shaped to movably retain at least a portion of said connecting member;

a connecting member, each of said first and said second bodies independently slidable mounted on said connecting member;

retaining means for retaining said first and said second bodies on said connecting member, said retaining means movably retaining said connecting member in part in said first body passageway and in further part in said second body passageway; and attaching means for attaching said first and said second bodies to the bottom of the sole of a ski boot.

10. The device of claim 9 wherein:

said retaining means includes an elongated biasing means having ends, said biasing means for biasing said first and said second bodies with respect to one another; and one of said ends of said biasing means connecting to said first body and the other of said ends of said biasing means connecting to said second body.

11. The device of claim 10 wherein:

said connecting member is hollow; and said biasing means includes an elongated spring positioned in part within said hollow connecting member.

12. The device of claim 9 further including:

said retaining means including an elongated spring having ends;

said connecting member having a hollow interior;

said elongated spring located in part within said hollow interior of said connecting member; and one of the ends of said elongated springs attaching to said first body and the other of said ends of said elongated spring attaching to said second body.

13. The device of claim 12 wherein:

said attaching means includes first and second brackets each for fitting over the edge of the sole of said ski boot, said first bracket attaching to said first body and said second bracket attaching to said second body; and one of said brackets fitting over the edge of the sole of said ski boot at the toe of said ski boot and the other of said brackets fitting over the edge of the sole of said ski boot at the heel of said ski boot.

14. The device of claim 9 wherein:

at least a portion of said bottom surface of each of said first and said second bodies is formed as a portion of a conical surface of rotation; and said conical surface of rotation is centered about an axis that is essentially parallel with a heel to toe axis of said ski boot.

15. A device for attaching to a ski boot comprising:

a body;

said body having a front section and a rear section;

each of said front and said rear sections having a top surface for mating against the sole of a ski boot;

means for connecting said body to the sole of a ski boot;

each of said front and said rear sections having a bottom surface for contacting a supporting surface; and at least a portion of said bottom surface of each of said front and said rear sections being formed as a tapering surface of rotation that is essentially arcuate about an axis that is essentially parallel with a heel to toe axis of said ski boot and is essentially tapered about an axis that is essentially perpendicular to said heel to toe axis of said ski boot and passes from side to side through said ski boot.

16. The device of claim 15 wherein:

said tapering surface of rotation of said front section tapers from a border area positioned proximal to said rear section to a narrower area positioned distal to said rear section; and said tapering surface of rotation of said rear section tapers from a broader area positioned proximal to said front section to a narrower area positioned distal to said front section.

17. The device of claim 16 wherein:

said tapering surface of rotation of said front section comprises a portion of a conical surface; and said tapering surface of rotation of said rear section comprises a portion of a conical surface.

18. The device of claim 15 further including:

said front section and said rear section each independent from the other;

connecting means for movably connecting said front and rear sections to one another; and at least one of said front and said rear sections being movable with respect to said connecting means.

19. The device of claim 18 further including:

biasing means for biasing said front and rear sections towards one another.

20. The device of claim 18 wherein:

said connecting means includes a connecting member, said front and rear sections each movably mounted on said connecting member.

* * * * *